US008695898B2

(12) United States Patent
DeVries et al.

(10) Patent No.: US 8,695,898 B2
(45) Date of Patent: Apr. 15, 2014

(54) SPOUT INCLUDING A STREAM STRAIGHTENER

(75) Inventors: Adam M. DeVries, Anderson, IN (US); DeWayne Davis, Lebanon, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 902 days.

(21) Appl. No.: 12/331,957

(22) Filed: Dec. 10, 2008

(65) Prior Publication Data

US 2010/0139796 A1 Jun. 10, 2010

(51) Int. Cl.
*A62C 31/00* (2006.01)

(52) U.S. Cl.
USPC ..... 239/445; 239/438

(58) Field of Classification Search
CPC ..... B05B 12/14
USPC ..... 239/445, 461, 492, 493, 518, 523, 524, 239/569, 589, 438
See application file for complete search history.

(56) References Cited

U.S. PATENT DOCUMENTS

| | | | | |
|---|---|---|---|---|
| 1,118,118 | A | 11/1914 | Fischer | |
| 2,120,620 | A * | 6/1938 | Mowery | 239/426 |
| 2,331,741 | A | 10/1943 | Smith | |
| 2,567,176 | A | 9/1951 | Ballard | |
| 3,801,997 | A | 4/1974 | Ward | |
| 3,902,671 | A | 9/1975 | Symmons | |
| 3,906,983 | A | 9/1975 | Parkison | |
| 4,187,986 | A * | 2/1980 | Petrovic | 239/449 |
| 4,653,693 | A | 3/1987 | Steingass | |
| 4,655,395 | A * | 4/1987 | Cioffi et al. | 239/427 |
| 5,651,531 | A | 7/1997 | Lu | |
| 6,301,727 | B1 | 10/2001 | Bertrand et al. | |
| 2004/0227016 | A1* | 11/2004 | Yagi et al. | 239/524 |
| 2006/0255167 | A1 | 11/2006 | Vogel et al. | |

* cited by examiner

*Primary Examiner* — Davis Hwu
(74) *Attorney, Agent, or Firm* — Faegre Baker Daniels LLP

(57) ABSTRACT

A faucet spout assembly including a spout shell and a stream straightener insert. The spout shell includes an inlet end, an outlet end, and a waterway that extends between the inlet end and the outlet end. Water flows around the stream straightener insert and is delivered from the outlet end of the spout shell in a laminar, sheet-like column, giving the appearance of a large volume of water being dispensed from the faucet spout assembly.

23 Claims, 8 Drawing Sheets

SPOUT INCLUDING A STREAM STRAIGHTENER

BACKGROUND AND SUMMARY

The present disclosure relates generally to faucet spout assemblies and, more particularly, to a faucet spout assembly incorporating a stream straightener insert.

A faucet spout assembly traditionally includes a spout shell that defines a waterway. In use, water is introduced into an inlet end of the spout shell and is directed through the waterway. The water is then delivered from an outlet end of the spout shell into a receiver, such as sink, a bath tub, or a shower basin.

To increase the turbulence of the water delivered from the outlet end of the spout shell, the faucet spout assembly may include an aerator. The aerator mixes air into the water stream, thereby increasing the velocity of the water stream, reducing splashing, and/or conserving water, for example.

The present disclosure provides a faucet spout assembly including a stream straightener insert. Water flows around the insert and is delivered from the outlet end of the spout shell in a laminar, sheet-like column having a hollow center portion, giving the appearance of a large volume of water being dispensed from the faucet spout assembly.

According to an illustrative embodiment of the present disclosure, a faucet spout assembly includes a spout shell having an inlet end coupled to a fixed mounting surface, an outlet end, and a waterway that extends between the inlet end and the outlet end. An insert is coupled to the spout shell to define a hollow stream of water dispensed from the outlet end of the spout shell.

According to a further illustrative embodiment of the present disclosure, a faucet spout assembly includes a spout shell having an inlet end, an outlet end, and a waterway that extends between the inlet end and the outlet end. A diverter valve assembly is received within the spout shell and includes a plug that is configured to open and close the waterway. An insert is received within the spout shell and includes a body that forces water around the insert and prevents water from being dispensed through the insert to define a hollow stream of water dispensed from the outlet end of the spout shell.

According to another illustrative embodiment of the present disclosure, a faucet spout assembly includes a spout shell having an inlet end coupled to a fixed mounting surface, an outlet end, and a waterway that extends between the inlet end and the outlet end. The waterway is at least partially defined by an interior surface of the spout shell. An insert is received within the waterway of the spout shell and includes an exterior surface. The interior surface of the spout shell and the exterior surface of the insert cooperate to define a hollow stream of water dispensed from the outlet end of the spout shell.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

Figure 1:
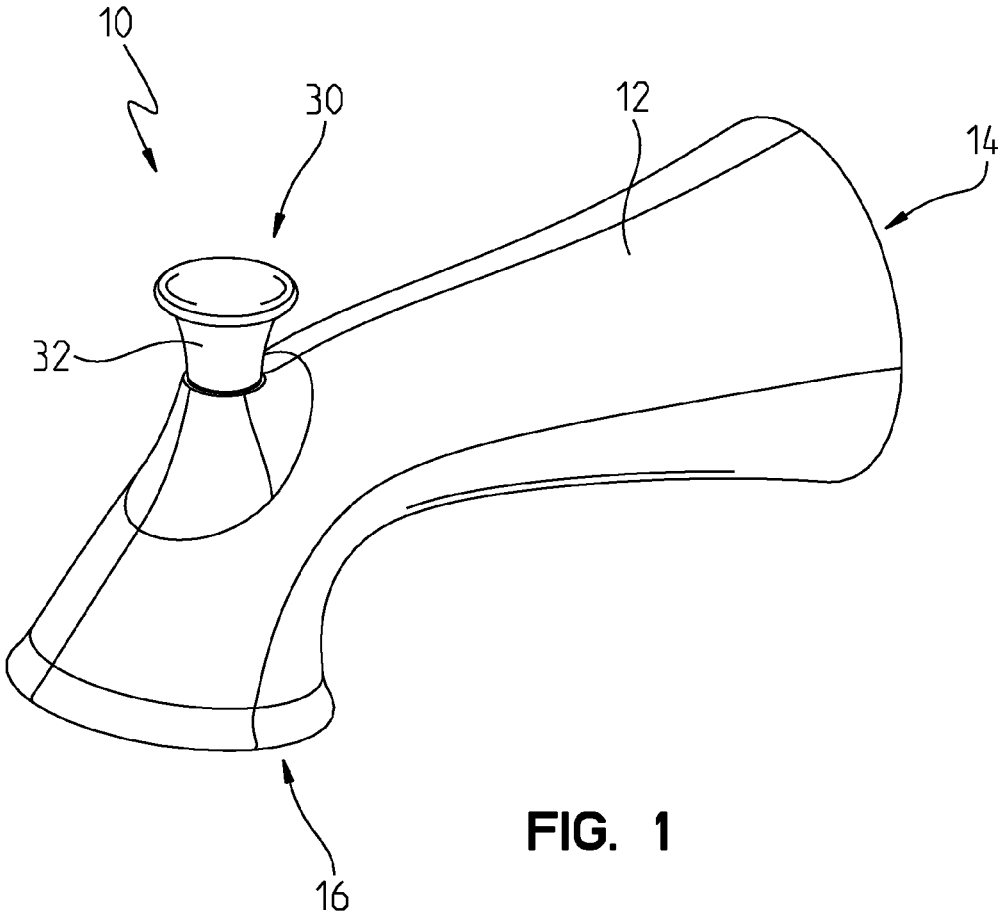
FIG. 1 is a perspective view of an illustrative faucet spout assembly of the present disclosure.
Figure 2:
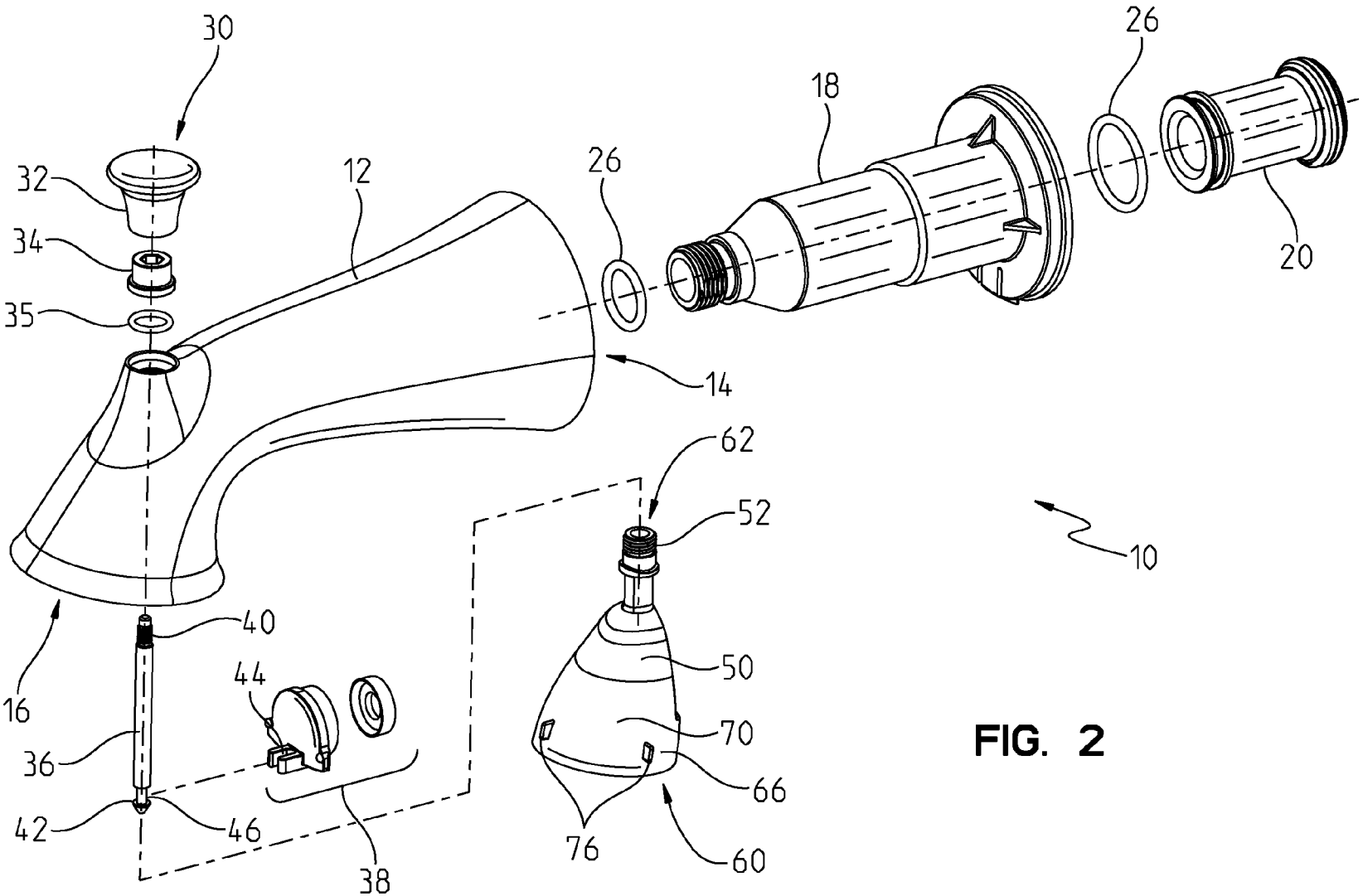
FIG. 2 is a front exploded perspective view of the faucet spout assembly of FIG. 1.
Figure 3:
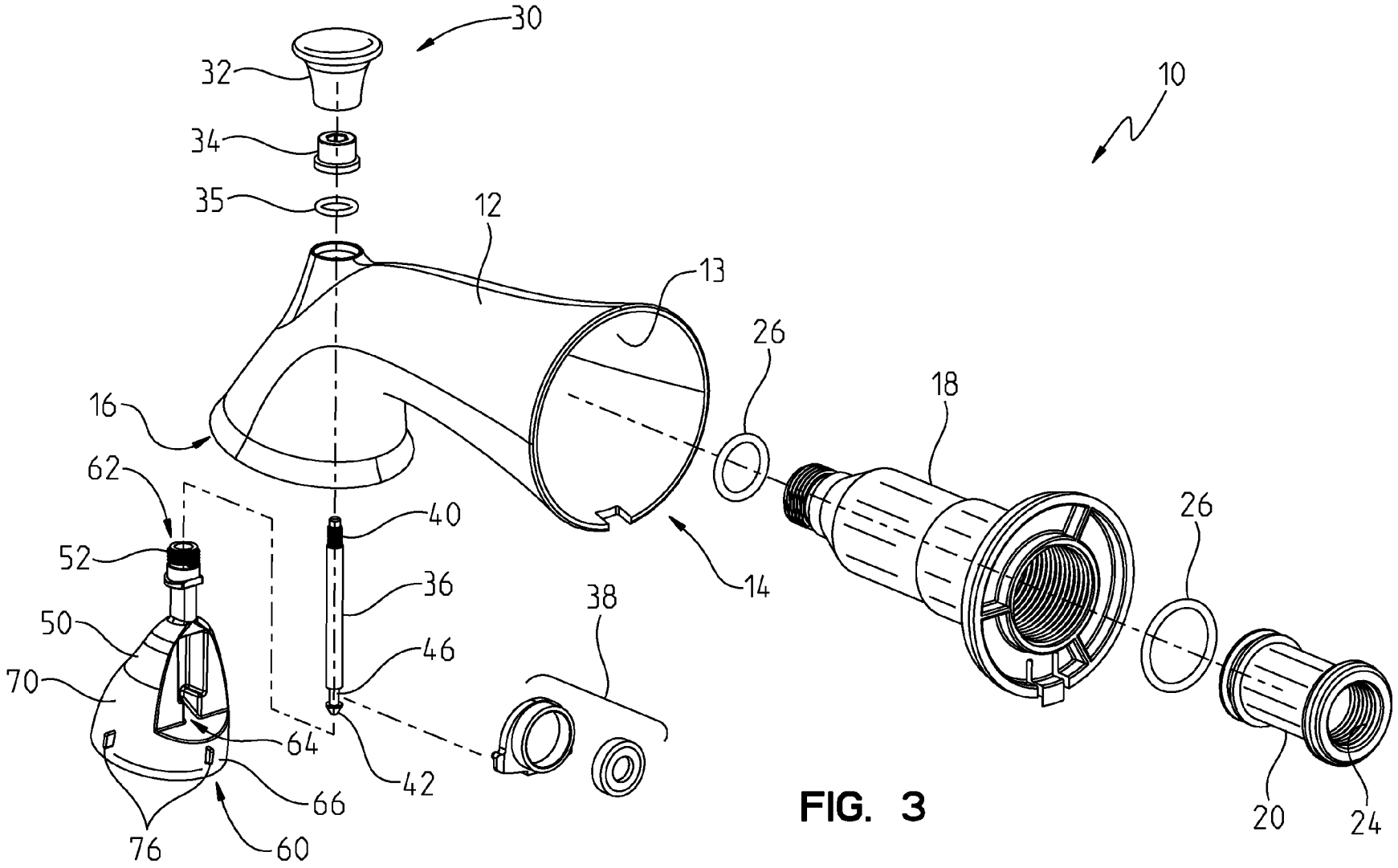
FIG. 3 is a rear exploded perspective view of the faucet spout assembly of FIG. 1.

Referring initially to FIGS. 1-3, the present disclosure relates to a faucet spout assembly, illustratively a wall-mounted faucet spout assembly 10 for a bath tub. While the present disclosure relates to a faucet spout assembly 10 for use with a bath tub, it should be appreciated that the faucet spout assembly 10 may find use with other faucets, including those mounted to a horizontal mounting deck or vertical wall for dispensing water into a sink or basin.

Faucet spout assembly 10 illustratively includes spout shell 12 having interior surface 13 that extends between inlet end 14 and outlet end 16. Spout shell 12 may be formed of a rigid metal material, such as brass, steel, zinc, or chrome, a rigid polymer material, or a rigid ceramic material, for example.

Figure 4:
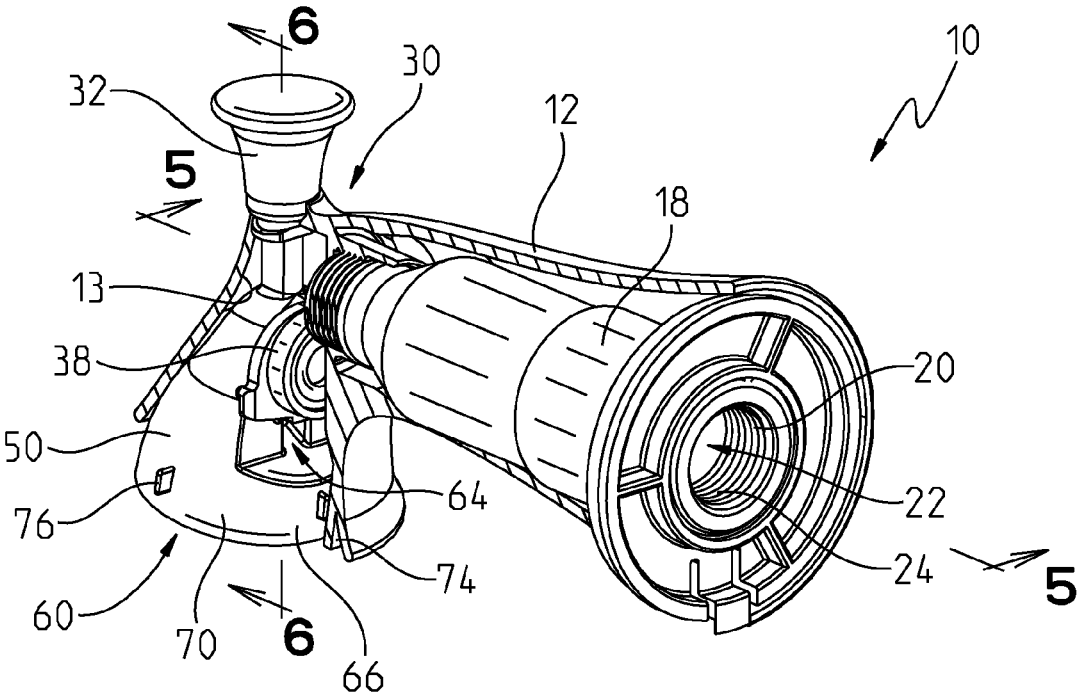
FIG. 4 is a partial cross-sectional perspective view of the faucet spout assembly of FIG. 1, showing a diverter valve assembly in an open position.
Figure 5:
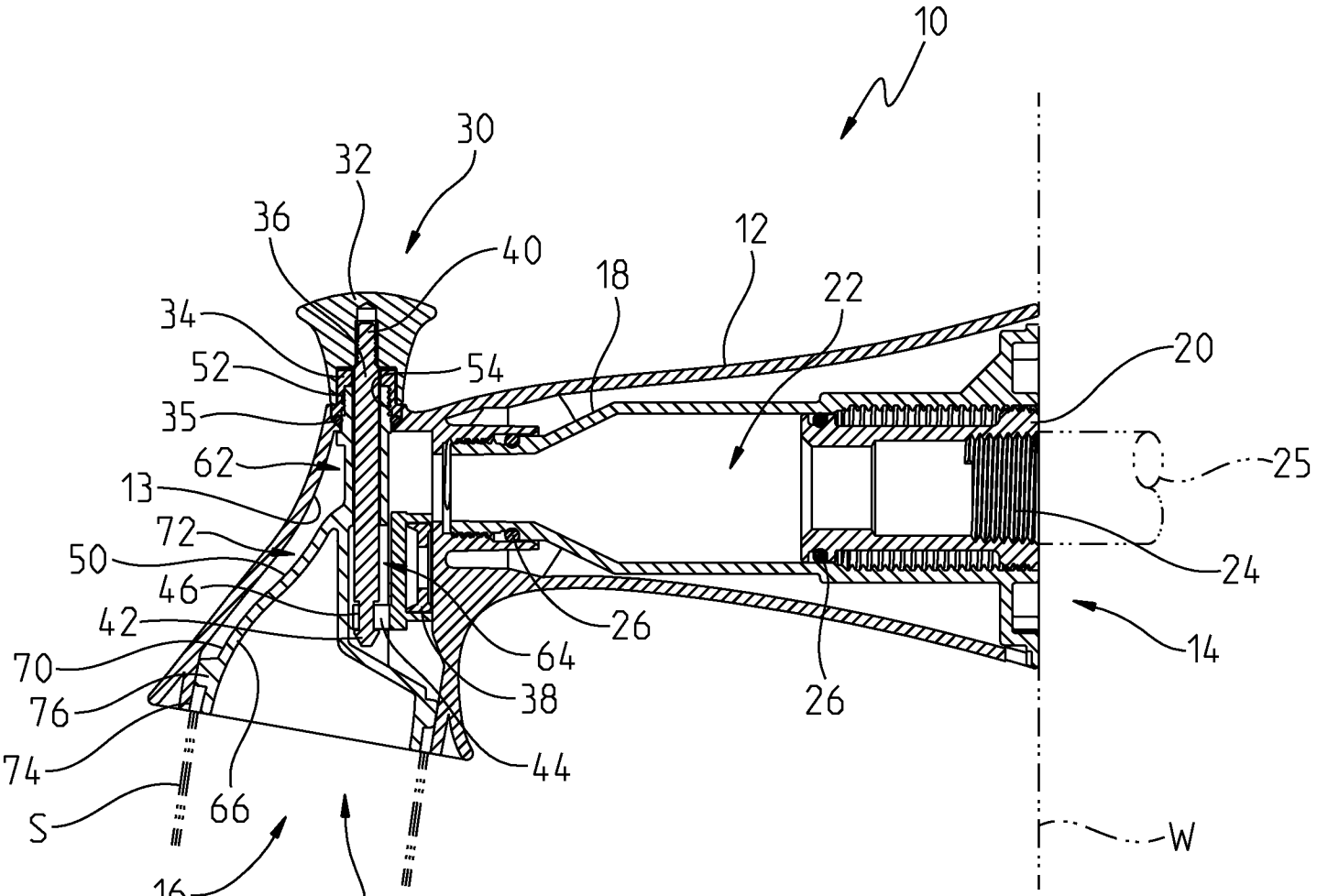
FIG. 5 is a cross-sectional view of the faucet spout assembly of FIG. 4, taken along line 5-5 of FIG. 4, showing a diverter valve assembly in an open position.

Referring next to FIGS. 4 and 5, faucet spout assembly 10 also includes hollow conduit 18 and inlet port 20. Conduit 18 and inlet port 20 are received within spout shell 12. Together, spout shell 12, conduit 18, and inlet port 20, cooperate to define waterway 22. Inlet port 20 includes internal threads 24 for coupling with a conventional water supply line 25 that extends from a fixed mounting surface, such as wall W (FIG. 5). In use, water from the supply line 25 is directed into inlet end 14 of spout shell 12 and flows through waterway 22. As shown in FIGS. 2 and 3, conduit 18 and inlet port 20 may be provided with a suitable number of sealing rings 26 to reduce water leakage between the components.

Referring again to FIGS. 1-3, faucet spout assembly 10 also includes diverter valve assembly 30. According to an exemplary embodiment of the present disclosure, illustrated in FIGS. 2 and 3, diverter valve assembly 30 includes handle 32, cap 34, sealing ring 35, stem 36, and plug 38. Cap 34 and sealing ring 35 of diverter valve assembly 30 are coupled to spout shell 12 to prevent water in waterway 22 from leaking out of spout shell 12. Handle 32, stem 36, and plug 38 of diverter valve assembly 30 are coupled together and are movably received within spout shell 12. Specifically, top end 40 of stem 36 is coupled to handle 32, and bottom end 42 of stem 36 is coupled to plug 38. Handle 32, stem 36, and/or plug 38 may be integrally formed or coupled together using a suitable attachment method. For example, handle 32 may be threaded onto top end 40 of stem 36. As another example, plug 38 may include clip 44 that is configured to snap into annular groove 46 of stem 36. According to an exemplary embodiment of the present disclosure, diverter valve assembly 30 may be removed from spout shell 12 and replaced, if necessary.

Figure 7:
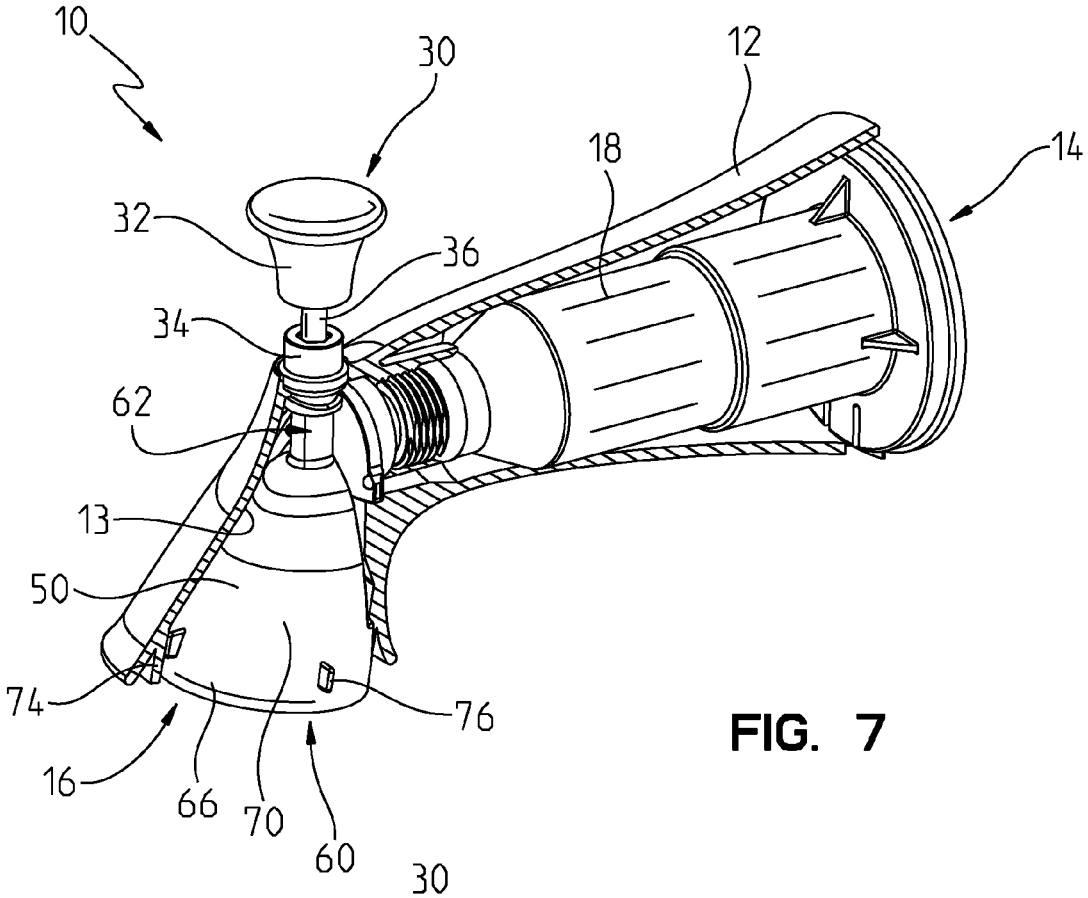
FIG. 7 is a front partial cross-sectional perspective view of the faucet spout assembly of FIG. 1, showing a diverter valve assembly in a closed position.
Figure 8:
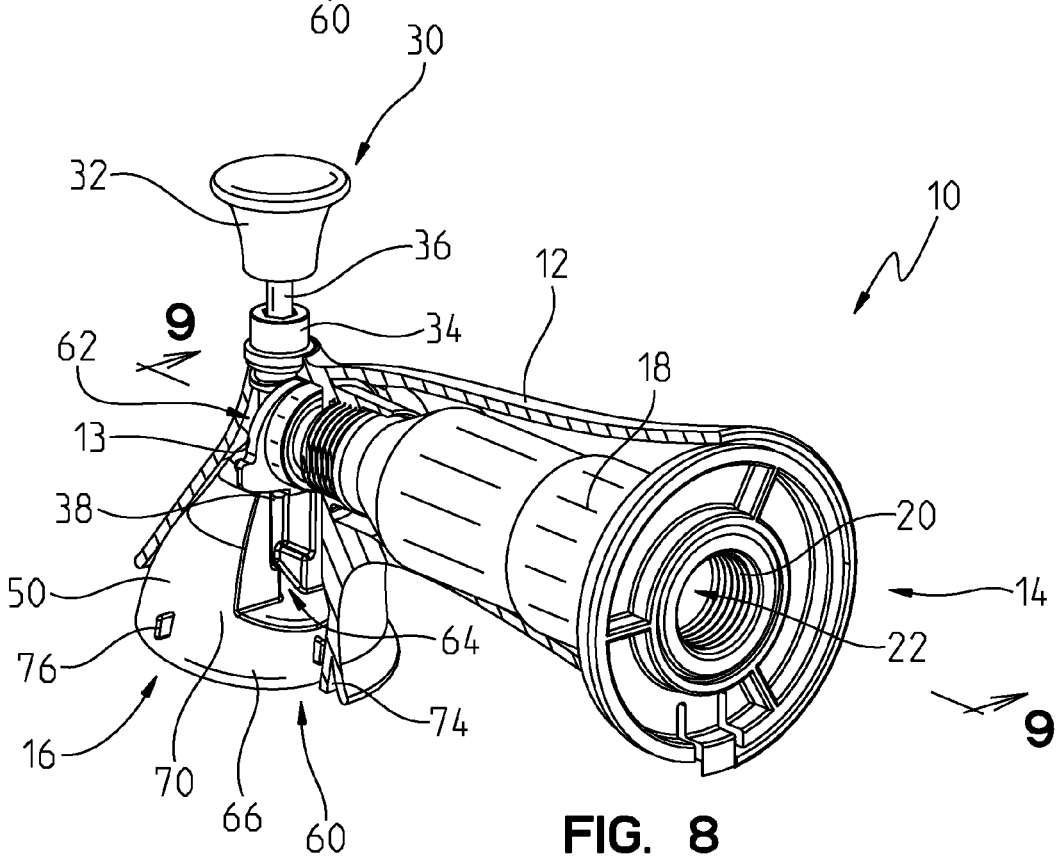
FIG. 8 is a rear partial cross-sectional perspective view of the faucet spout assembly of FIG. 7, showing a diverter valve assembly in a closed position.
Figure 9:
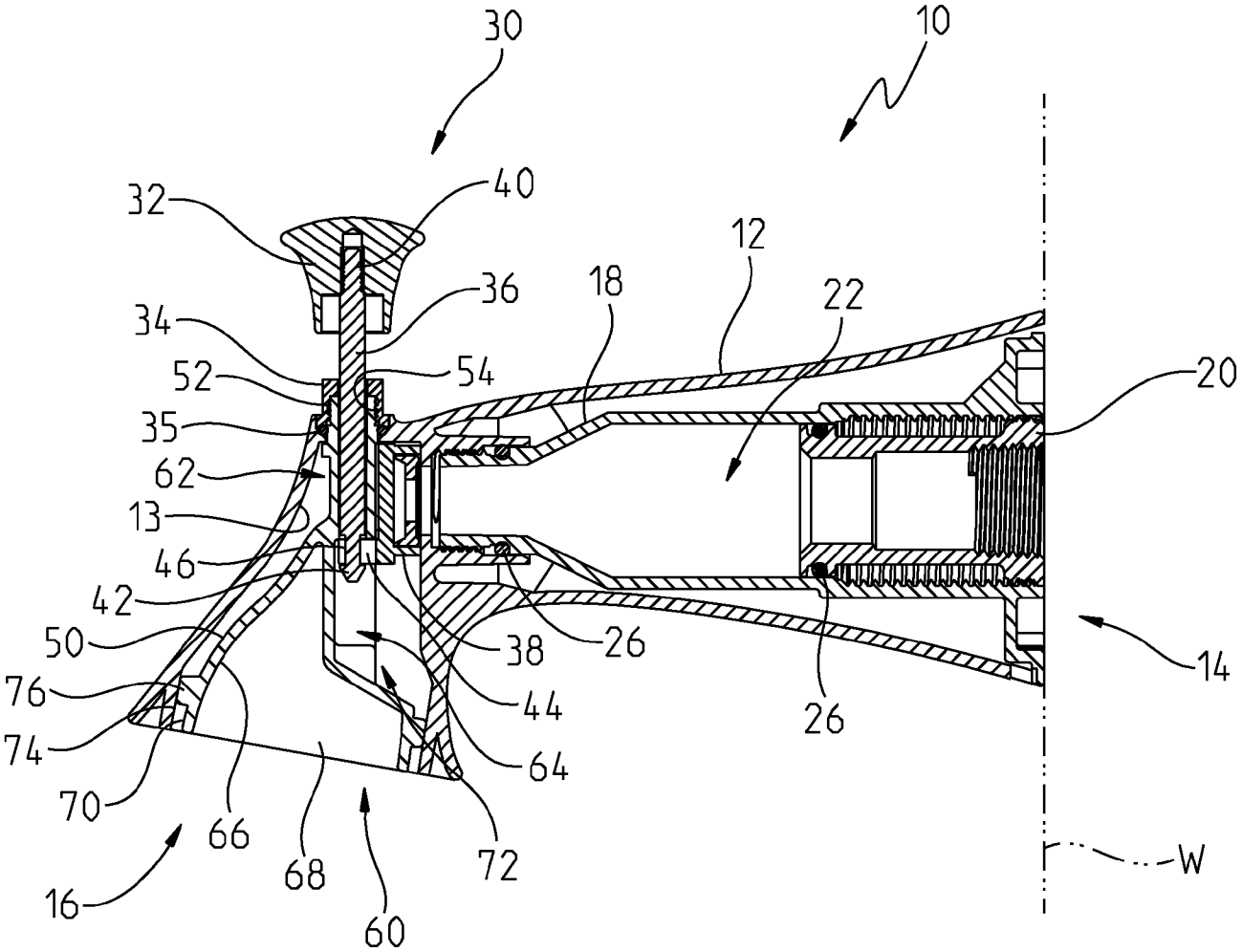
FIG. 9 is a cross-sectional view of the faucet spout assembly of FIG. 8, taken along line 9-9 of FIG. 8, showing a diverter valve assembly in a closed position.

Diverter valve assembly 30 allows a user to open and close faucet spout assembly 10. Diverter valve assembly 30 is illustrated in the open position in FIGS. 4-6, thereby allowing the flow of water from inlet port 20 to outlet end 16. With handle 32 of diverter valve assembly 30 lowered relative to spout shell 12, waterway 22 is not obstructed by plug 38. Thus, water entering waterway 22 flows through outlet end 16 of spout shell 12 and may be delivered into a bath tub (not shown), for example. Diverter valve assembly 30 is illustrated in the closed position in FIGS. 7-9, thereby preventing water from flowing from inlet port 20 to outlet end 16. With handle 32 of diverter valve assembly 30 raised relative to spout shell 12, stem 36 and plug 38 coupled thereto are also raised to obstruct waterway 22. Thus, water entering waterway 22 is prevented from flowing to outlet end 16 of spout shell 12. Instead, the water may be diverted to a different fluid delivery device, such as a shower head (not shown).

Figure 10:
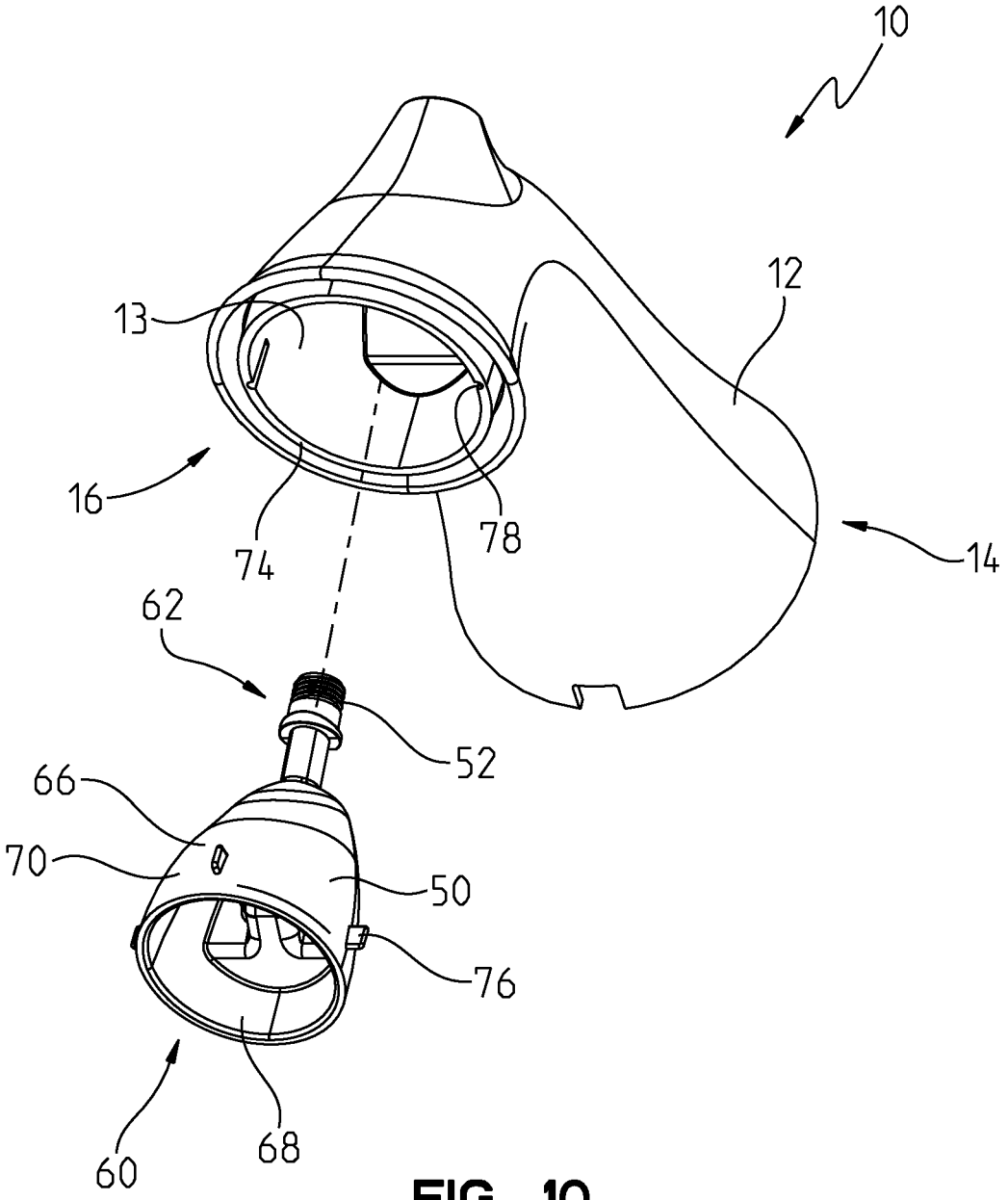
FIG. 10 is a partially exploded perspective view of the faucet spout assembly of FIG. 1.

Referring next to FIG. 10, faucet spout assembly 10 further includes insert 50. Insert 50 may be received within spout shell 12, and specifically within outlet end 16 of spout shell 12. In one embodiment, insert 50 may be coupled directly to spout shell 12. In another embodiment, insert 50 may be coupled to conduit 18. In yet another embodiment, illustrated in FIGS. 2, 3, and 5, insert 50 may be coupled to cap 34 of diverter valve assembly 30. For example, insert 50 may include external threads 52, and cap 34 may include internal threads 54 configured to mate with external threads 52 of insert 50 to hold insert 50 within outlet end 16 of spout shell 12. According to an exemplary embodiment of the present disclosure, insert 50 may be removed from spout shell 12 and replaced, if necessary. Insert 50 may be formed of a rigid metal material, a rigid polymer material, or a rigid ceramic material, for example.

Referring back to FIGS. 2 and 3, an illustrative insert 50 is sized and shaped to fit within outlet end 16 of spout shell 12. According to an exemplary embodiment of the present disclosure, insert 50 may be sized and shaped to reduce and/or to avoid obstructing the free flow of water through waterway 22, thereby reducing the potential for water to be inadvertently diverted to a shower head (not shown), also known as shower rise. For example, insert 50 may be a bell-shaped body that narrows from base end 60 to top end 62 to fit within outlet end 16 of spout shell 12 by mimicking (i.e. following the contour of) the narrowing shape of spout shell 12. It is also within the scope of the present disclosure that insert 50 may be located at and/or extend beyond outlet end 16 of spout shell 12, while still being positioned in fluid communication with waterway 22.

Also, an exemplary insert 50 is sized and shaped to accommodate diverter valve assembly 30. For example, insert may include passage 64 that is configured to receive stem 36 and plug 38 of diverter valve assembly 30. In the illustrative embodiment of FIG. 6, stem 36 and clip 44 extending from plug 38 are able to move freely within passage 64 as diverter valve assembly 30 is opened and closed.

Figure 6:
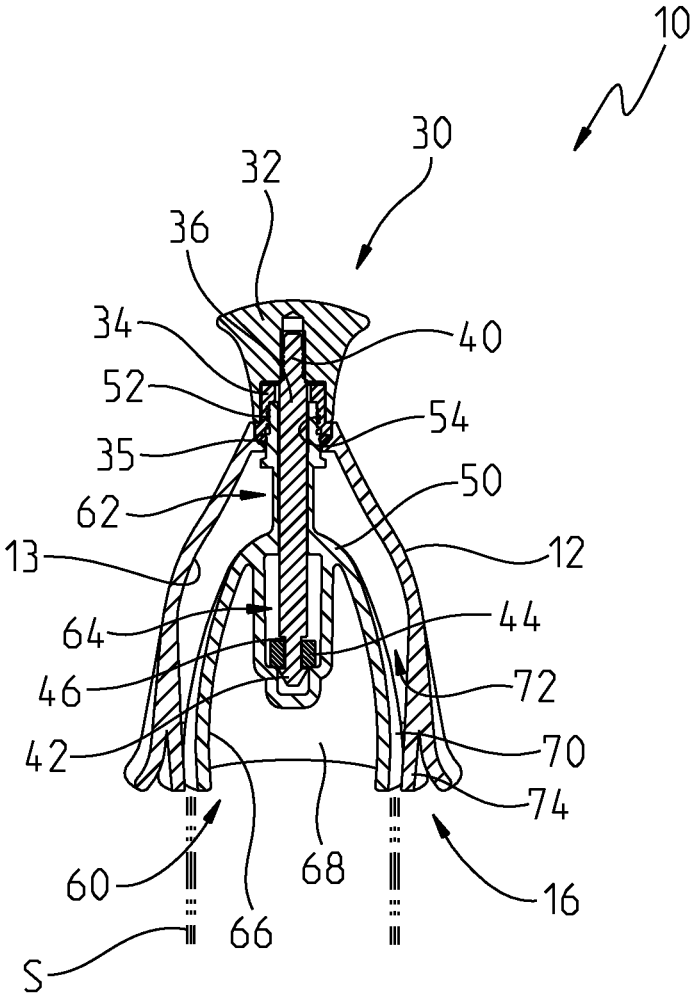
FIG. 6 is a cross-sectional view of the faucet spout assembly of FIG. 4, taken along line 6-6 of FIG. 4, showing a diverter valve assembly in an open position.

Referring to FIGS. 5 and 6, insert 50 includes wall 66 defining a hollow chamber 68 and an exterior surface 70. In operation, when diverter valve assembly 30 is in the open position, water flows through waterway 22 and around insert 50. Because exterior surface 70 of insert 50 is solid and lacks apertures, the water is not able to flow through insert 50. Rather, the water is forced to flow around insert 50. After flowing around insert 50, the water is illustratively delivered in a substantially laminar, sheet-like column referred to herein as hollow stream S. Hollow stream S provides an aesthetically pleasing flow pattern, giving the appearance of a large volume of water being dispensed from faucet spout assembly 10. Hollow stream S may extend smoothly and continuously until contacting a solid surface beneath faucet spout assembly 10, such as a surface of a bath tub (not shown).

According to an exemplary embodiment of the present disclosure, water flows through gap 72 located between wall 68 of insert 50 and spout shell 12, and specifically through gap 72 located between exterior surface 70 of insert 50 and interior surface 13 of spout shell 12. As shown in FIG. 5, interior surface 13 of spout shell 12 may include flange 74. Along flange 74, interior surface 13 of spout shell 12 and exterior surface 70 of insert 50 may extend substantially parallel to one another to promote substantially laminar water flow through gap 72. The distance between insert 50 and spout shell 12 (or the thickness of gap 72) may determine the wall thickness of hollow stream S.

According to another illustrative embodiment of the present disclosure, insert 50 includes at least one alignment tab 76 that projects outwardly from exterior surface 70 of wall 66. Alignment tab 76 maintains a desired minimum distance between insert 50 and spout shell 12. In an embodiment, multiple alignment tabs 76 are distributed around insert 50 to control the spacing between insert 50 and spout shell 12 around the perimeter of insert 50. Also, alignment tabs 76 may prevent insert 50 from rotating relative to spout shell 12. For example, as shown in FIG. 10, spout shell 12 may include alignment grooves 78 that are aligned and sized to receive alignment tabs 76 that project from insert 50. In addition, alignment tabs 76 may promote the substantially laminar flow of water around insert 50. In one embodiment, alignment tabs 76 are spaced above base end 60 of insert 50. The continuous columnar flow of water around insert 50 may be interrupted by alignment tabs 76; however, after passing over alignment tabs 76, the continuous columnar flow of water may be restored near base end 60 of insert 50. It is also within the scope of the present disclosure that the alignment tabs may extend from shell 12 and may be received within grooves in insert 50, for example.

The cross-sectional shape of insert 50 determines the cross-sectional shape of hollow stream S. According to an exemplary embodiment of the present disclosure, inserts 50 may be provided in various cross-sectional shapes to alter the cross-sectional shape of hollow stream S. For example, the cross-sectional shape of insert 50 may be circular, elliptical, triangular, square, rectangular, or another polygonal shape, to provide water streams having corresponding cross-sectional shapes.

While this invention has been described as having preferred designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A faucet spout assembly comprising:

a spout shell including an inlet end coupled to a fluid coupler supported by a fixed mounting surface, an outlet end, and a waterway that extends between the inlet end and the outlet end, the waterway extending about a first longitudinal axis in a first direction at the inlet end and about a second longitudinal axis in a second direction substantially perpendicular to the first direction at the outlet end; and an insert coupled to the spout shell, the insert nested within the spout shell and having a shape which follows an inner contour of the spout shell proximate the outlet end to define an annular outlet channel, the outlet channel narrowing at the outlet end of the spout shell to provide a substantially laminar, continuous hollow stream of water from the outlet end of the spout shell, the hollow stream defined as a sheet-like column.

2. The faucet spout assembly of claim 1, wherein the insert includes a body that forces water around the insert and prevents water from being dispensed through the insert.

3. The faucet spout assembly of claim 1, wherein the spout shell includes a flange that extends essentially parallel to at least a portion of the insert, the insert and the flange of the spout shell cooperating to define the hollow stream.

4. The faucet spout assembly of claim 1, wherein the insert has a cross-sectional shape that includes at least one of a circle, an ellipse, and a polygon.

5. The faucet spout assembly of claim 1, wherein the insert includes a base end and a top end, the insert narrowing from the base end to the top end.

6. The faucet spout assembly of claim 1, wherein at least one of the insert and the spout shell includes at least one alignment tab extending therefrom, the at least one alignment tab controlling a distance between the insert and the spout shell and positioned within the outlet channel.

7. The faucet spout assembly of claim 6, wherein at least one of the insert and the spout shell includes at least one alignment groove configured to receive the at least one alignment tab to prevent the insert from rotating relative to the spout shell.

8. The faucet spout assembly of claim 1, further comprising a diverter valve assembly configured to open and close the waterway, wherein the insert includes a chamber that is sized to accommodate at least a portion of the diverter valve assembly.

9. A faucet spout assembly comprising:

a spout shell including an inlet end threadedly coupled to a fluid coupler supported by a fixed mounting surface, an outlet end, and a waterway that extends between the inlet end and the outlet end;

a diverter valve assembly received within the spout shell, the diverter valve assembly including a plug that is configured to open and close the waterway; and an insert received within the spout shell, the insert including a body that forces water around the insert and prevents water from being dispensed through the insert to define a hollow stream of water dispensed from the outlet end of the spout shell, and at least one of the insert and the spout shell includes at least one alignment tab extending therefrom, the at least one alignment tab being positioned between the insert and the spout shell for controlling a distance between the insert and the spout shell.

10. The faucet spout assembly of claim 9, wherein the insert and the spout shell cooperate to define the hollow stream of water.

11. The faucet spout assembly of claim 9, wherein the spout shell includes a flange that extends essentially parallel to at least a portion of the insert, the insert and the flange of the spout shell cooperating to define the hollow stream.

12. The faucet spout assembly of claim 9, wherein the insert has a cross-sectional shape that includes at least one of a circle, an ellipse, and a polygon.

13. The faucet spout assembly of claim 9, wherein the insert includes a base end and a top end, the insert narrowing from the base end to the top end.

14. The faucet spout assembly of claim 9, wherein at least one of the insert and the spout shell includes at least one alignment groove configured to receive the at least one alignment tab to prevent the insert from rotating relative to the spout shell.

15. The faucet spout assembly of claim 9, wherein the insert includes a chamber that is sized to accommodate at least a portion of the diverter valve assembly.

16. A faucet spout assembly comprising:

a fluid conduit threadedly coupled to a fluid coupler supported by a fixed mounting surface;

a spout shell including an inlet end for receiving the fluid conduit, an outlet end, and a waterway that extends between the inlet end and the outlet end, the waterway at least partially defined by an interior surface of the spout shell at the outlet end and extending about a first longitudinal axis in a first direction at the inlet end and about a second longitudinal axis in a second direction substantially perpendicular to the first direction at the outlet end; and an insert received within the waterway of the spout shell and including an exterior surface, the interior surface of the spout shell being configured to extend substantially parallel to the exterior surface of the insert to define an annular channel for dispensing a hollow stream of water from the outlet end of the spout shell, the annular channel narrowing at the outlet end of the spout shell to promote substantially laminar flow of the hollow stream from the faucet spout assembly.

17. The faucet spout assembly of claim 16, wherein the insert has a cross-sectional shape that includes at least one of a circle, an ellipse, and a polygon.

18. The faucet spout assembly of claim 16, wherein the insert includes a base end and a top end, the insert narrowing from the base end to the top end.

19. The faucet spout assembly of claim 16, wherein at least one of the insert and the spout shell includes at least one alignment tab extending therefrom, the at least one alignment tab controlling a distance between the insert and the spout shell and positioned within the annular channel.

20. The faucet spout assembly of claim 19, wherein at least one of the insert and the spout shell includes at least one alignment groove configured to receive the at least one alignment tab to prevent the insert from rotating relative to the spout shell.

21. The faucet spout assembly of claim 16, further comprising a diverter valve assembly configured to open and close the waterway, wherein the insert includes a chamber that is sized to accommodate at least a portion of the diverter valve assembly.

22. The faucet spout assembly of claim 1, wherein the hollow stream is dispensed from the outlet end of the spout shell in a direction substantially parallel to a longitudinal axis of the spout shell.

23. The faucet spout assembly of claim 16, wherein the hollow stream is dispensed from the outlet end of the spout shell in a direction substantially parallel to a longitudinal axis of the spout shell.

* * * * *